US005803393A

United States Patent [19]

Julian

[11] Patent Number: 5,803,393

[45] Date of Patent: Sep. 8, 1998

[54] STRIP DECOILER

[76] Inventor: Joseph Julian, 23 Doe Meadow Ct., Southington, Conn. 06489

[21] Appl. No.: 754,433

[22] Filed: Nov. 21, 1996

[51] Int. Cl.[6] ..... B65H 23/06; B65H 77/00

[52] U.S. Cl. ..... 242/420.6; 242/563; 242/564

[58] Field of Search ..... 242/420.6, 413.5, 242/418.1, 419.1, 420.3, 421.7, 563, 564

[56] References Cited

U.S. PATENT DOCUMENTS

| | | | |
|---|---|---|---|
| 3,381,913 | 5/1968 | Bachman | 242/78.6 |
| 3,930,523 | 1/1976 | Marlasca Garcia | 242/420.6 X |
| 3,933,322 | 1/1976 | Satzinger | 242/55 |
| 3,995,758 | 12/1976 | Kovaleski | 214/330 |
| 4,169,566 | 10/1979 | Boudouris et al. | 242/55.18 |
| 4,249,705 | 2/1981 | Brooks et al. | 242/78.6 |
| 4,269,369 | 5/1981 | Stroup | 242/45 |
| 4,290,561 | 9/1981 | Satzinger | 242/55 |
| 4,290,563 | 9/1981 | Brooks et al. | 242/78.6 |
| 4,304,370 | 12/1981 | Box et al. | 242/78.6 |
| 4,582,271 | 4/1986 | Takahashi | 242/55 |
| 4,610,408 | 9/1986 | Box et al. | 242/78.6 |
| 4,848,694 | 7/1989 | Julian | 242/128 X |
| 4,899,945 | 2/1990 | Jones | 242/420.6 |
| 4,979,692 | 12/1990 | Julian | 242/420.6 |
| 5,007,597 | 4/1991 | Jones | 242/420.6 |
| 5,546,993 | 8/1996 | Summey, III et al. | 242/413.5 X |

*Primary Examiner*—John Q. Nguyen
*Attorney, Agent, or Firm*—Dallett Hoopes

[57] ABSTRACT

A turntable has a drive for rotating it. A vertical control rod extending up alongside the turntable carries a dancer arm adjustably mounted thereon. The strip coming off the supply coil trains over the spool. A variable electrical control is adjacent the control rod and influenced by its rotary position. The control relates the speed of the turntable to whether the arm is inward or outward—whether there is greater or less demand for the strip. In the preferred version, a bias for the control rod urges the dancer arm outward in dampened fashion but more readily permits the arm to be drawn inward.

5 Claims, 3 Drawing Sheets

STRIP DECOILER

FIELD OF THE INVENTION

This invention relates to strip decoilers such as are used to supply strip to punch presses and the like. More specifically, this invention relates to an adjustable decoiler which accommodates to different diameters of the supply, different sizes of strip, different demands and different heights of strip supply. It avoids deformation of the strip.

BACKGROUND OF THE INVENTION

In my earlier patent U.S. Pat. No. 4,848,694 I disclosed a strip decoiler in which the strip passes over the spool of a dancer arm on its way to the press. The arm pivots on a horizontal rod. Depending on variations in the demand for strip by the press, the diameter of the supply spool, etc. the drive is controlled by the position of the dancer arm.

The arrangement of the prior patent is indeed meritorious. The present invention may be regarded as an improvement. It is especially adapted to accommodate strips coming off a stack of strip coil wherein as the coils are used up, the level of supply grows lower. Length of stroke and rapidity of stroke of remarkable variety are all handled smoothly by this decoiler.

It is a further object of the invention to provide means for reducing the violence and clatter which would otherwise be present as the press abruptly demands lengths of strip, one after another, in machine-gun-like rapidity. Less violence, of course, means less damage to the strip.

SUMMARY OF THE INVENTION

The invention comprises a turntable, a drive for rotating the turntable, a vertical control rod extending alongside the turntable, and a dancer arm adjustably mounted on the control rod with a spool on its end. A variable electrical control is adjacent the control rod and influenced by the rotary position thereof. The control adjusts the speed of the turntable to whether the arm is inward or outward relative to the turntable.

In the preferred version, a bias for the control rod urges the dancer arm outward in dampened fashion but more readily permits the arm to be swung inward by the strip.

BRIEF DESCRIPTION OF THE DRAWINGS

Other objects and features of the invention will be clear to those skilled in the art from reference to the following specification and drawings, all of which disclose a non-limiting embodiment of the invention. In the drawings.

DESCRIPTION OF THE PREFERRED EMBODIMENT

Figure 1:
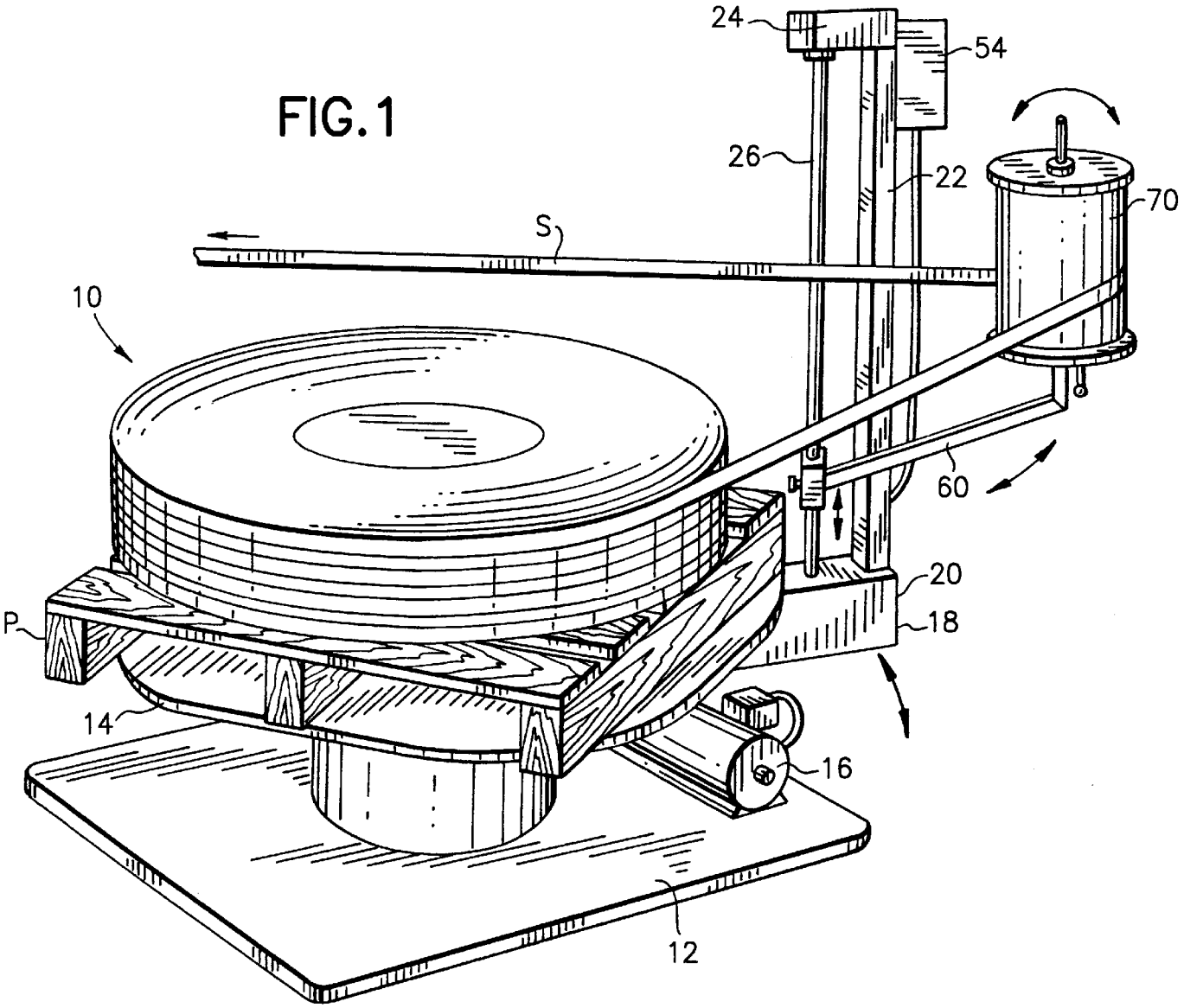
FIG. 1 is a perspective view showing an apparatus embodying the invention used with a pallet holding a stack of coil strip.

An apparatus embodying the invention is generally designated 10 in FIG. 1. It comprises a base 12, a turntable 14 rotatably mounted on the base, and a drive 16 in the form of an electric motor connected to the turntable by gears (not shown).

On the turntable in FIG. 1 is disclosed a pallet P and a stack of coils of strip material S. As shown, the axis of the coils approximates the axis of the turntable.

Figure 2:
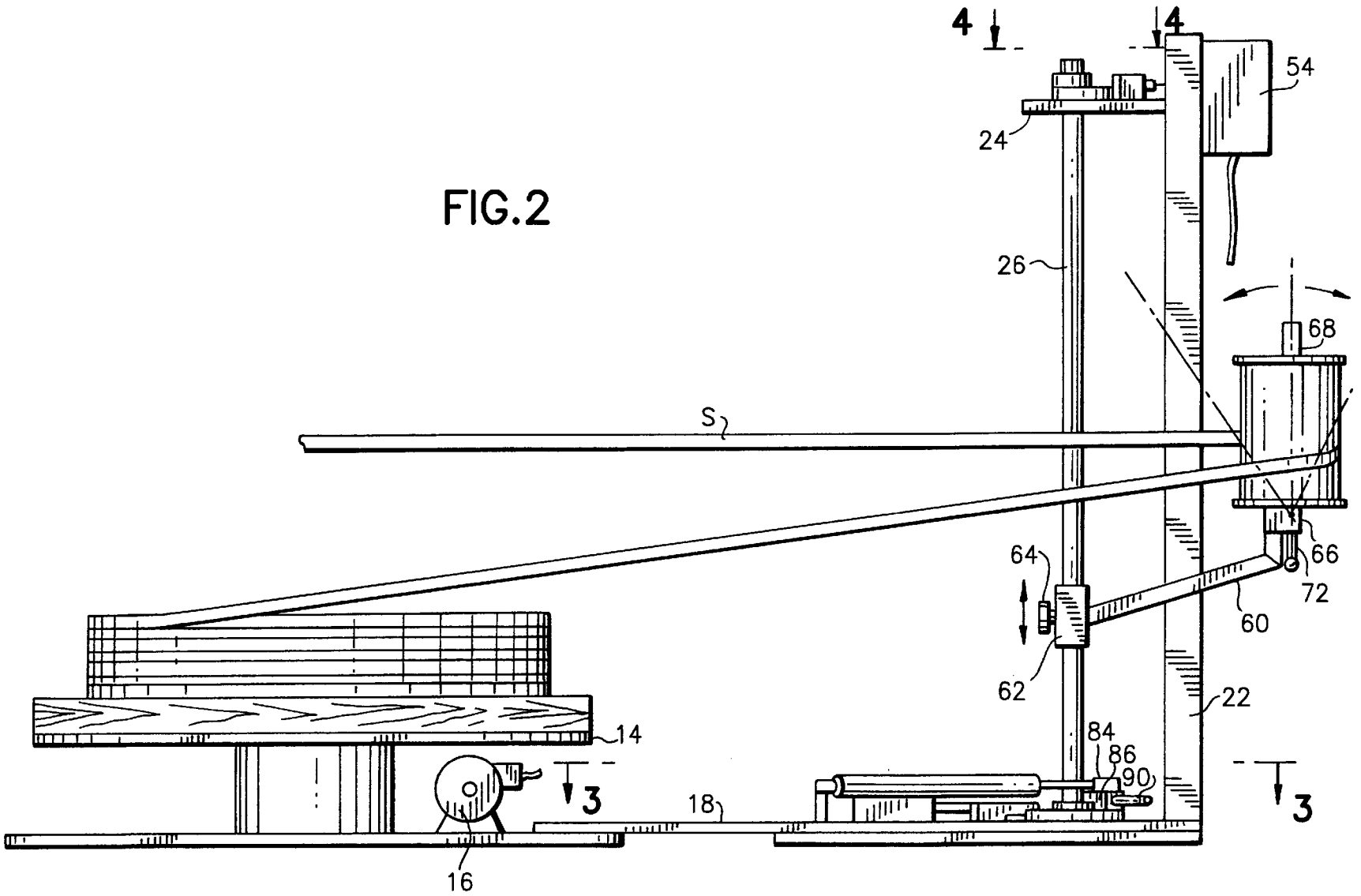
FIG. 2 is a side elevational view of the apparatus with the cover of the foot and head removed.
Figure 3:
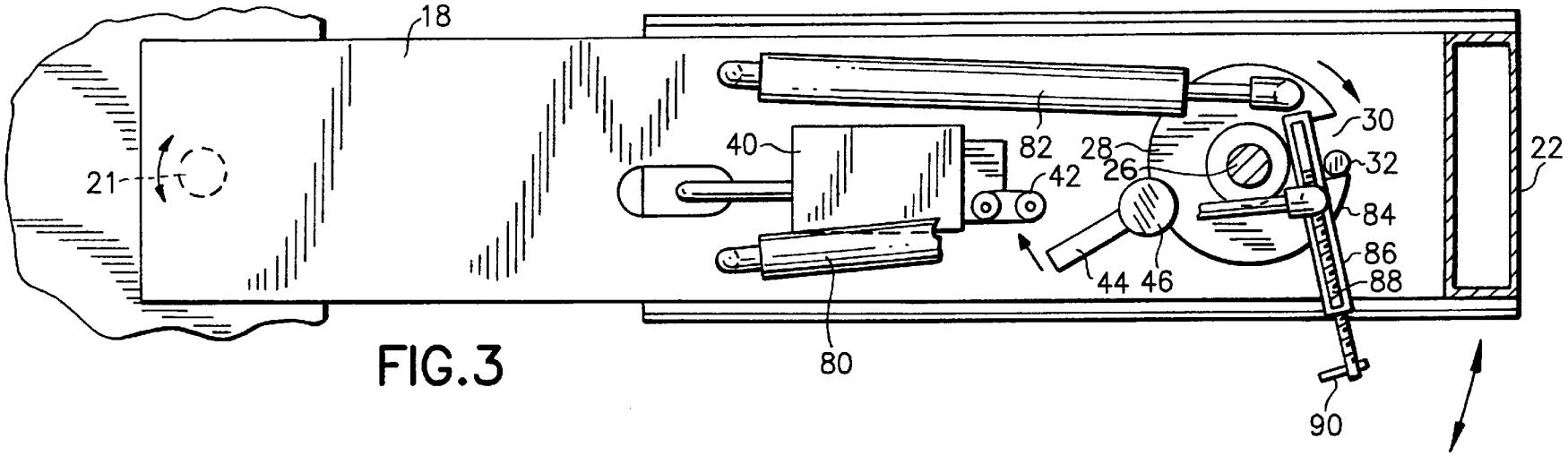
FIG. 3 is an enlarged sectional view taken on the line 3—3 of FIG. 2.

Adjustably secured to the base 12 at one side of the turntable is a foot 18 which is normally covered by a housing 20. The foot, as shown in FIG. 3, is pivotally attached as at 21 to the base 12 and clamping bolts (not shown) fix the position. As shown in FIG. 2, the foot may comprise a double thickness of plate—the underplate being channel shaped—so that the upper plate is disposed flatly where it sits on both the base 12 and the underplate.

Extending upward from the distal end of the foot is the mast 22 which is vertical and provided at its upper end with a lateral head 24. Journaled in aligned openings in the foot 18 and the head 24 is the vertical control rod 26. The openings are actually bushings (not shown). The lower end of the rod is provided with a flanged coupling plate or disk 28 rigidly secured to the rod and adapted to turn with it. As shown in FIG. 3, the disk 28 may be formed with a notch 30. A stop pin 32 is secured to the foot 18 in the notch so that as the disk 28 pivots, the sides of the notch selectively engage the pin 32 to limit the rotary travel of the rod.

A limit switch 40 is mounted on the foot 18 and provided with an actuator 42. The disk 28 carries, as shown in FIG. 3, an adjustable finger 44 which is adjustably pivotally attached by a commercially available mount 46. The angle of the finger 44 relative to the plate 28 may be adjusted so that its distal end engages the limit switch actuator 42 to cut off the drive when the rod 26 reaches an appropriate rotary position to be explained.

The upper end of the rod 26 is provided with an outward metal lobe 50 rigidly mounted on the rod 26 to turn with it. Mounted generally adjacent the lobe on the head 24 is the digital proximity sensor 52 sensitive to the relative proximity of the end surface of the lobe 50.

An inclined dancer arm 60 is vertically adjustably mounted on the control rod 26. More specifically, the inner end of the arm 60 is fixed to a sleeve 62 surrounding the rod. The sleeve carries a threaded thumb screw 64. By loosening the thumb screw, the arm 60 may be vertically adjusted on the rod 26.

The distal end of the arm 60 includes a fixture 66 which supports a spindle 68 which loosely receives a rotatable spool 70. Preferably the spool is formed with outward flanges on each end as shown although a wire retainer or the like extending parallel to the surface of the spool may be regarded as an equivalent with the purpose of retaining the strip on the spool. The flanges are preferred because they do not require a threading of the strip under the retainer. The spool, of course, is free to rotate on the spindle.

The fixture 66 supports the spindle and its angle of support as indicated by the center lines (FIG. 2) and the arrows can be adjusted and fixed by a threaded fastener 72 or the like controlled by the lever shown.

It will be seen that the swinging movement of the arm 60 fixed on the rod 26 effects a rotary movement of the rod 26. Thus, as the spool 70 moves from an inward position closer to the strip coil to an outward position away from the coil, the rod 26 turns correspondingly. The only limit on the travel of the arm is the pin 32 (FIG. 3) and the sides of the notch 30 in the coupling disk 28.

Referring again to FIG. 3, the bias on the rotation of the rod 26 is clearly set forth. On opposite sides of rod 26 the disk 28 mounts one end of a conventional gas spring 80 and one end of a hydraulic shock absorber 82 respectively. The opposite ends of the gas spring 80 and the shock absorber 82 are securely mounted to the foot 18. It can thus be seen that the influence of the gas spring 80 and the hydraulic shock absorber 82 oppose each other with respect to the rotary motion of the rod 26.

The mounting of the end of the gas spring 80 to the disc 28 is made adjustable to increase or decrease as necessary the force of the gas spring available to push out the arm 60 (FIG. 2). If, for instance, the strip being decoiled is a heavy strip, wide or thick, more effort is required to push out the arm than for lighter strip. Thus it is important to be able to adjust the force exerted by spring 80. This is done, as shown in FIG. 3, by increasing—or decreasing if less force is needed—the moment arm to the rod 26.

For this purpose the end of the gas spring carries a nut 84 and the disc 28 is provided with a yoke 86 fixed to the disc. The yoke is disposed in a direction generally perpendicular to the gas spring 80. The yoke 86 journals for rotation a threaded rod 88, the end of which is provided with a hand crank 90. The rod 88 operatively receives the nut 84. By this structure a turn of the crank can move the nut inward or outward with respect to the axis of the rod 88 and change the moment arm and thereby change the force which urges the arm outwardly.

Important to the preferred form of the invention are the characteristics of the gas spring and hydraulic shock selected.

To understand the problem confronting the Applicant, it frequently happens in a stamping operation that the stamping machine jerks forward the strip a distance or pitch which varies from, say 2" to 2', perhaps more. This may happen at a rate of one to three times a second. The object of the invention, aside from the more expectable attributes apparent from the drawings is that the delivery is effected with a minimum of violence and clatter and a minimum of denting or deforming of the strip itself. If the arm is permitted uncontrolled swinging, there will be excessive damage of the strip and the resulting end product. For this reason the bias has been carefully designed.

In the first place, the arm must, of course, be biased in a direction away from the turntable so that slack will generally be taken up in the loop which goes around the spool. This continuous outward component of the bias of the arm is supplied, of course, by the gas spring 80. In the dancer arms with horizontal pivots of the prior art—for instance, that shown in my earlier patent Pat. No. 4,848,694—the bias has been provided by a weight on the opposite side of the pivot moving together with the dancer arm. In such arrangements where there is no control or damping of the outward movement of the arm, the arm will swing quickly outward only to be immediately hauled in as the press jerks forward its next length of strip.

In embodiments of the present invention, the effect of gravity is not a factor as in prior art decoilers where the dancer is controlled without damping by gravity. Because here the rod 26 has a vertical axis, gravity is out of the equation. In the preferred embodiment, the movement of the arm is controlled. The outward movement of the arm is urged by spring 80 but dampened by the hydraulic shock absorber 82 which applies a damping action under compression only and slows down the outward movement of the arm in anticipation of the imminent abrupt pulling of the press for the next length. Thus, the arm will move outward more slowly and the inward pulling of the strip will not come as a sudden jolt which would happen otherwise. The inward movement of the arm, on the other hand, is not damped by the hydraulic shock and the arm quickly yields to the extent necessary to the pulling of the press for the next length.

As a result, in spite of the abrupt jerking demand for strip the decoiler runs smoothly with a minimum of violence irrespective of whether the length of the forward jerk is 2" or 3' and whether it occurs at 60 or 200 times a minute.

In the preferred embodiment the gas spring 80 selected may be one manufactured by SUSPA Model No. C16-14907 rated at 60 PSI. The hydraulic shock 82 may be one manufactured by AVM Model No. SD300RC5PS006 rated at 50 pounds with free extension.

Figure 4:
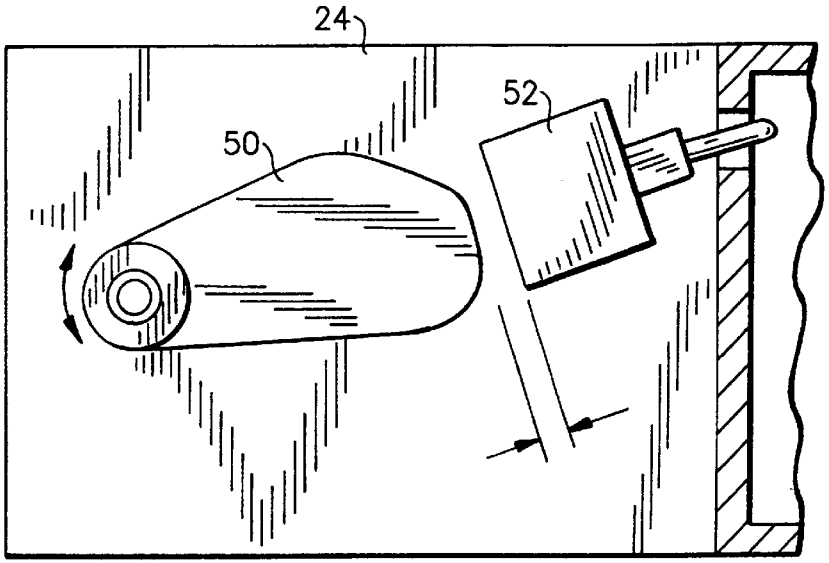
FIG. 4 is a greatly enlarged fragmentary view taken on the line 4—4 of FIG. 2.

Returning to FIG. 4, the rotary movement of rod 26 will effect, as the rim of the lobe approaches closer to the sensor 52 in the embodiment shown, a speeding up of the drive 16 and the turntable 14. This is because the arm 60 approaches the inward position signaling a demand for strip S. Conversely, as the arm moves away and spool 70 is farther from the turntable 14, the rim of the lobe 50 connected to rod 26 backs off away from the sensor 52 and thereby slows down the drive 16 until the press catches up. This continual adjustment takes place while the press and decoiler are running.

Figure 5:
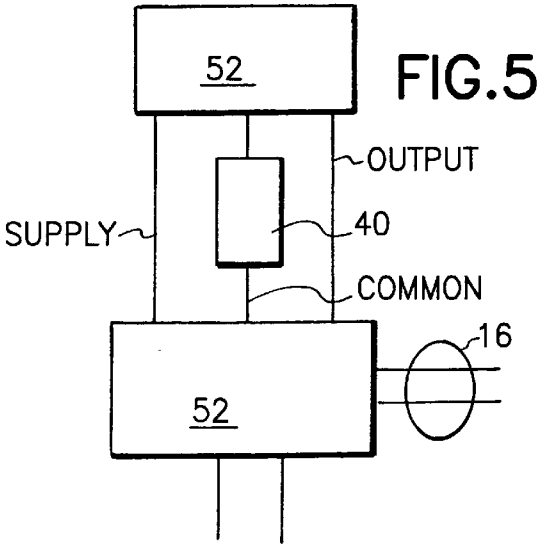
FIG. 5 is a simplified wiring diagram showing the relative electrical components.

Reference is now made to FIG. 5 showing in a simplified way the control circuitry. The power is delivered to the control 54 as shown, and from the control a controlled voltage is delivered to the drive 16. Influencing the control as shown are the proximity sensor 52 and the limit switch 40. Thus, the signal returned to the control 54 from the sensor controls speed of the drive 16. The limit switch 40, when nudged by finger 44 (FIG. 3)—as when the coil is depleted and the decoiler reaches the bitter end—the control 54 will shut down the drive 16 altogether. It may also shut down the press if desired or necessary.

The electrical components of an actual embodiment are control 54 obtained from KB Electronics (Model KBPC 240D); analog proximity sensor 52 obtained from Turik (Model B115CK40LIUH1141); and safety limit switch 40 obtained from Schmersal Model Z4VH33602Z.

The operation of the apparatus shown has been described herein in piecemeal fashion, but the overall operation and sequence should be inferable by those skilled in the art. Briefly, as the decoiling proceeds, slack in the strip is detected as the arm 60 moves outward proportionately. The sensor senses the remoteness of the lobe 50 and slows down the drive. Conversely, when the arm 60 detects the tightening of the strip, the arm moves slightly closer to the periphery of the coil and the lobe 50, being more proximate the sensor 52 results in the speeding up of the turntable.

A special benefit of the invention is that the arm 60 may be raised by adjustment of the sleeve 62 on the rods 26 as described. This will accommodate the uncoiling of strip from the upper or lower positions in the stack of strip S as shown. In other words, when the top strip is used up, the arm 16 can be dropped slightly to accommodate the next lower coil and so on.

If a subsequent coil supply is from an opposite sense, i.e., clockwise rather than counter-clockwise, or vice-versa, the strip is rerouted oppositely around the outside of the spool and the drive reversed.

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. A strip decoiler comprising:

a. a base having a lateral housing, b. a turntable supported on the base and having a vertical axis and adapted to support a stack of coils of strip disposed on the sides of the coils, c. a drive means for rotating the turntable, d. a control rod rotatably mounted in the housing and extending vertically up from the housing outside the periphery of the turntable, e. a dancer arm vertically adjustably mounted on the control rod and keyed for rotary movement therewith and extending outward therefrom and having a distal end, the arm being swingable from inward position to outward position relative to the turntable, f. a spool spindle having a lower end and swivelly adjustably mounted on the distal end of the dancer arm, g. a spool rotatably mounted on the spool spindle, h. a control means comprising a metal lobe mounted at an end of the control rod and a proximity sensor fixedly secured to the base opposite the lobe and sensitive to the relative proximity of an end surface of the lobe, and electrically connected to the drive means to increase or decrease the speed of the turntable when the arm is inward or outward respectively relative to the turntable, and i. a bias biasing the control rod toward a rotary position whereat the spool is outward from the turntable, comprising a plate mounted radially on the lower end of the control rod and supporting offset couplings on opposite sides of the rod, the couplings being respectively connected to one end of a gas spring urging the rod in a direction with the arm toward an outward position and to one end of an hydraulic shock absorber damping the movement toward the outward position but offering no damping toward the inward position, the other respective ends of the gas spring and shock absorber being fixedly secured in the housing, and means mounted on the plate for supporting and adjusting the position of the coupling connected to the gas spring radially inward or outward of the axis of the turntable.

2. A strip decoiler as claimed in claim 1 wherein the housing has an upward mast and a lateral head at the upper end thereof, the head journaling the upper end of the control rod.

3. A strip decoiler as claimed in claim 1 wherein the head supports the proximity sensor.

4. A strip decoiler as claimed in claim 1 wherein the coupling of the gas spring is in the form of a yoke secured to the plate and carrying a rotatable threaded rod generally parallel to the plate and a nut operatively engaging the threaded rod and secured to said one end of the gas spring.

5. A strip decoiler as claimed in claim 1 wherein the control rod is provided with a positive rotary stop to define the limits of travel of the dancer arm.

* * * * *